US010287082B2

(12) United States Patent
Sharman

(10) Patent No.: US 10,287,082 B2
(45) Date of Patent: May 14, 2019

(54) PACKAGING

(71) Applicant: Meatology Limited, London (GB)

(72) Inventor: Peter Sharman, London (GB)

(73) Assignee: Meatology Limited, London (GB)

( * ) Notice: Subject to any disclaimer, the term of this patent is extended or adjusted under 35 U.S.C. 154(b) by 0 days.

(21) Appl. No.: 14/430,397

(22) PCT Filed: Sep. 24, 2013

(86) PCT No.: PCT/GB2013/052489
§ 371 (c)(1),
(2) Date: Mar. 23, 2015

(87) PCT Pub. No.: WO2014/045066
PCT Pub. Date: Mar. 27, 2014

(65) Prior Publication Data

US 2015/0225161 A1 Aug. 13, 2015

(30) Foreign Application Priority Data

Sep. 24, 2012 (GB) ..... 1217025.4

(51) Int. Cl.
*B65D 77/04* (2006.01)
*B65D 3/20* (2006.01)
(Continued)

(52) U.S. Cl.
CPC ..... *B65D 77/0413* (2013.01); *B65D 3/04* (2013.01); *B65D 3/20* (2013.01); *B65D 5/0209* (2013.01);
(Continued)

(58) Field of Classification Search
CPC ..... A47G 21/001; A47G 19/03; A47G 19/06; B65D 5/0209; B65D 85/36
(Continued)

(56) References Cited

U.S. PATENT DOCUMENTS 3,003,207 A * 10/1961 Powers ..... A47G 21/001 229/103.2
3,912,331 A * 10/1975 Turner ..... B65D 3/06 229/104
(Continued)

FOREIGN PATENT DOCUMENTS

DE 202005014737 U1 3/2007
DE 102006028824 U 11/2007
(Continued)

*Primary Examiner* — Shawn M Braden
(74) *Attorney, Agent, or Firm* — Olson & Cepuritis, Ltd.; Arne M. Olson; Kathleen A. Lyons

(57) ABSTRACT

A foodstuff packaging assembly for transporting a sandwich, said sandwich having, a top, a bottom and a circumferential outside edge, said packaging assembly comprising a substantially cylindrical transit guard having a top end edge at one end of the cylinder and a bottom end edge at the other end of the cylinder and a side wall having an internal side wall surface and an external side wall surface, the internal side wall surface of the transit guard being so sized, shaped and configured as to substantially correspond to the circumferential outside edge of the sandwich in order to restrain the sandwich and its contents during transit. Optionally the food packaging assembly further comprises a packaging box adapted to accommodate a cylindrical transit guard, said packaging box comprising a bottom portion having a lowermost-in-use internal bottom surface, a top portion having an upper-most-in-use internal top surface, and at least one side wall having an internal side surface, the top portion and the bottom portion being adapted such that the packaging box can adopt an open configuration or a closed configuration.

15 Claims, 9 Drawing Sheets

(51) Int. Cl.

| | |
|---|---|
| ***B65D 5/02*** | (2006.01) |
| ***B65D 5/50*** | (2006.01) |
| ***B65D 3/04*** | (2006.01) |
| ***B65D 43/16*** | (2006.01) |
| ***B65D 43/22*** | (2006.01) |
| ***B65D 47/32*** | (2006.01) |
| ***B65D 85/00*** | (2006.01) |

(52) U.S. Cl.
CPC ..... *B65D 5/0245* (2013.01); *B65D 5/5042* (2013.01); *B65D 5/5045* (2013.01); *B65D 43/16* (2013.01); *B65D 43/22* (2013.01); *B65D 47/32* (2013.01); *B65D 85/70* (2013.01); *B65D 2205/02* (2013.01); *B65D 2585/363* (2013.01)

(58) Field of Classification Search
USPC ..... 220/676; 426/106
See application file for complete search history.

(56) References Cited

U.S. PATENT DOCUMENTS 4,109,848 A * 8/1978 Kipp ..... B65D 3/02 229/104
4,154,860 A * 5/1979 Daswick ..... B65B 25/22 426/113
4,160,533 A * 7/1979 Kotzur ..... B65D 5/5045 206/397
4,795,648 A * 1/1989 Capy ..... B65D 65/02 229/87.03
5,416,305 A * 5/1995 Tambellini ..... B65D 81/32 219/730
5,740,951 A * 4/1998 Jack ..... A45C 11/20 220/903
5,860,587 A * 1/1999 Young ..... A47G 21/001 229/107
5,875,956 A * 3/1999 Benarrouch ..... A47G 21/001 229/103.2
6,170,740 B1 * 1/2001 Clark ..... B65D 5/0209 229/104
6,719,190 B2 * 4/2004 Yocum ..... B65D 5/3685 229/104
6,860,399 B2 * 3/2005 Reeves ..... B65D 43/162 220/739
7,232,054 B2 * 6/2007 Yocum ..... B65D 5/4204 206/459.1
9,090,371 B2 * 7/2015 Hallam ..... B65D 5/0209
2006/0231599 A1 * 10/2006 Matthews ..... B65D 75/06 229/87.08
2007/0295794 A1 12/2007 Bestehorn et al.

FOREIGN PATENT DOCUMENTS

GB 256037 A 8/1926
GB 302648 A 9/1929
JP 2001322629 A 11/2001
WO 0029299 A1 5/2000
WO 03010049 A1 2/2003

* cited by examiner

PACKAGING

FIELD OF THE INVENTION

The present invention relates to food packaging. In particular the invention relates to a transit guard for a sandwich, to a food package and to a method of transporting a sandwich, primarily via a motor vehicle, whilst minimising the journey's effects on the sandwich's quality, moisture content, structure and appearance. It is particularly applicable, but in no way limited, to a transit guard and an associated box for transporting a burger-type sandwich.

BACKGROUND TO THE INVENTION

Take-away and delivered food is extremely popular around the globe, particularly in the UK and USA. Customers increasingly favour the convenience of being able to enjoy their favourite food either delivered out to them by car, motorbike, scooter or bicycle or collected by themselves to then be enjoyed in the comfort of their own homes, workplaces or offices. Whilst once primarily the domain of Pizza restaurants, the takeaway industry is now moving towards many types of cuisine such as Chinese, Indian, Burgers and hot sandwiches. Unlike other cuisines, the nature of burgers and sandwiches make them much harder to transport from the kitchen or restaurant's premises to the customers' homes. The multiple layers of food in a burger often come apart as the food is shaken. Furthermore, when subject to impact, traditional packaging solutions deform causing subsequent deformation and deterioration to the food. Upon arrival the bread may well be soggy or 'steamed', and the food can become so disturbed by the journey that it is no longer recognisable or appetising, and barely edible.

SUMMARY OF THE INVENTION

According to a first aspect of the present invention there is provided a foodstuff packaging assembly for transporting a sandwich, said sandwich having, a top, a bottom and a circumferential outside edge, said packaging assembly comprising a substantially cylindrical transit guard having a top end edge at one end of the cylinder and a bottom end edge at the other end of the cylinder and a side wall having an internal side wall surface and an external side wall surface, the internal side wall surface of the transit guard being so sized, shaped and configured as to substantially correspond to the circumferential outside edge and the height of the sandwich in order to restrain the sandwich and its contents during transit.

Providing a transit guard whose internal surface corresponds substantially to that of the sandwich and placing the transit guard over the sandwich prior to transit, results in the sandwich retaining both its shape and the arrangement of the fillings during transit.

Preferably the cylindrical transit guard comprises a substantially circular cylinder. A cylindrical shape is particularly suitable for transporting burgers, substantially circular rolls, or other circular shaped foodstuffs.

In an alternate preferred embodiment the cylindrical transit guard comprises a polygonal sided cylinder. In this way square or rectangular transit guards can be provided for regular sandwiches.

Preferably the cross-section of the cylinder of the cylindrical transit guard is substantially uniform in cross-section along substantially the whole length of the cylinder. This arrangement makes it easier to both load the sandwich into the transit guard before transit and remove the sandwich after transit. It will be understood however that cylinders of non-uniform cross-section also fall within the scope of this invention.

In a particularly preferred embodiment the packaging assembly further comprises a top portion, said top portion acting to substantially close the top end of the cylinder. By closing the top of the transit guard and having the top of the transit guard close to or touching the top of the sandwich, this minimises the opportunity for the sandwich contents to move during transit, whilst also allowing space for moisture to leave the inside of the transit guard into the gap between the outside of the transit guard and the inside of the outer box.

Preferably the transit guard further comprises one or more ventilation holes. These holes allow moisture to escape from inside the transit guard. More preferably at least one ventilation hole is located in the sidewall of the cylindrical transit guard.

In a further preferred embodiment at least one ventilation hole is located in the top portion of the cylindrical transit guard.

Preferably the cylindrical transit guard is formed from a foldable sheet material. Suitable sheet materials include paper, cardboard, polymers, polymer composites, and organic materials such as wood and bamboo, as selected by the materials specialist.

Preferably the assembled transit guard is foldable between a folded, flat-packed configuration and an unfolded open configuration ready for use. This saves considerably on storage space in the kitchen or other food preparation area where such transit guards are used.

Preferably the top portion, if present, and the side wall both incorporate fold lines to facilitate folding the transit guard into a flat packed configuration.

In a particularly preferred embodiment the foodstuff packaging assembly further comprises a packaging box adapted to accommodate the cylindrical transit guard, said packaging box comprising a bottom portion having a lowermost-in-use internal bottom surface, a top portion having an uppermost-in-use internal top surface, and at least one side wall having an internal side surface, the top portion and the bottom portion being adapted such that the packaging box can adopt an open configuration or a closed configuration.

It will be appreciated that a transit guard according to the present invention can be used with or without any other outer packaging to transport a sandwich. However it is preferred that the transit guard and sandwich are contained within some outer wrapper or carton during transit, such as a box as described herein. It is also possible that the transit guard may be joined to or forms an integral part of the packaging box. The transit guard could, for example, be joined to or form an integral part of the box top or the box bottom.

Preferably the top portion and the bottom portion of the packaging box are pivotally or hingedly connected. A hinged lid makes it easier to load the sandwich with its transit guard into the packaging box.

Preferably the packaging box further comprises a fastening means adapted to retain the packaging box in a closed configuration. A variety of fastening means are available including fastening tabs or loop fasteners, as specified by a fastening specialist.

Preferably the height of the cylindrical transit guard substantially corresponds to the internal height of the packaging box in its closed configuration. The transit guard is thus held captive within the box, preventing any significant internal movement of the sandwich or its contents during transit.

Preferably the diameter of the cylindrical transit guard substantially corresponds to the diameter or width of the packaging box. The operative diameter or width of the packaging box in this embodiment is the diameter or width of the lowermost-in-use internal surface of the packaging box or the uppermost-in-use internal top surface of the packaging box, or both.

Preferably the packaging box further comprises one or more ventilation holes. This ventilation allows any moisture which has escaped from the transit guard into the packaging box to also escape from the packaging box into the surrounding atmosphere. In the event that the burger is being delivered in a 'hot bag', moisture would vent to the hot bag rather than the normal atmosphere.

The Invention thus provides a transit guard for a sandwich, and a method of transporting a sandwich using a transit guard, the transit guard being either of elongated foldable sheet material, or from any of the materials described in relation to the transit guard above. The transit guard is primarily a tubular device which when lowered onto a sandwich will form a snug fit between the sandwich's outer perimeter and the internal perimeter of the transit guard. The transit guard is intended to be placed inside a simple, and possibly fastened, conventional box packaging. The guard, suitably dimensioned, will sit with its upper and lower surfaces in, or very nearly in, contact with the upper and lowermost faces of the box. The external perimeter of the transit guard will also be in close contact with the internal edges of the box minimising lateral movement of the food within the box.

The invention also includes the option to include perforations, apertures or ventilation holes around the transit guard, and the main box, in order to aid in the removal of moisture from the food, firstly to the compartment formed between the transit guard and any outer packaging and secondly from the outer packaging to the surroundings.

The inventor believes that the invention will find application particularly with hamburgers. However it may be used with the transportation of other foodstuffs and accordingly, in the context of this specification the term "sandwich" is to be interpreted broadly to include hamburgers and the like as well as a conventional sandwich made from sliced bread.

When formed from elongated, foldable sheet material the transit guard may be folded flat prior to use to reduce storage space requirement at the restaurant or kitchen. In one embodiment the tubular transit guard includes a top of the same cross section as the tube to provide vertical rigidity, to maintain the shape of the guard and hence the food contained within it. This top can designed using folds and either some form of adhesive or other method for affixing cuts and protrusions to one another.

To secure the sandwich and prevent damage to the food when it is subject to sudden vertical motion (e.g. the scooter transporting it hits a pot-hole or speed bump) it is advantageous to minimise the distance between the highest point of the food and the roof of the outer packaging or transit guard (if a topped guard is being employed). This could be a direct contact between the food and some part of the transit guard or outer box. Alternatively, a gap of approximately 1 to 6 cm above the top of the food and the top of the box or transit guard will greatly reduce the probability of the food rotating within the transit guard.

BRIEF DESCRIPTION OF THE DRAWINGS

The present invention will now be described, by way of example only, with reference to the accompanying drawings, wherein.

DESCRIPTION OF THE PREFERRED EMBODIMENTS

The present invention will now be described by way of example only. These are not the only ways that the invention may be put into practice, but they are the best ways currently known to the applicant.

Figure 1:
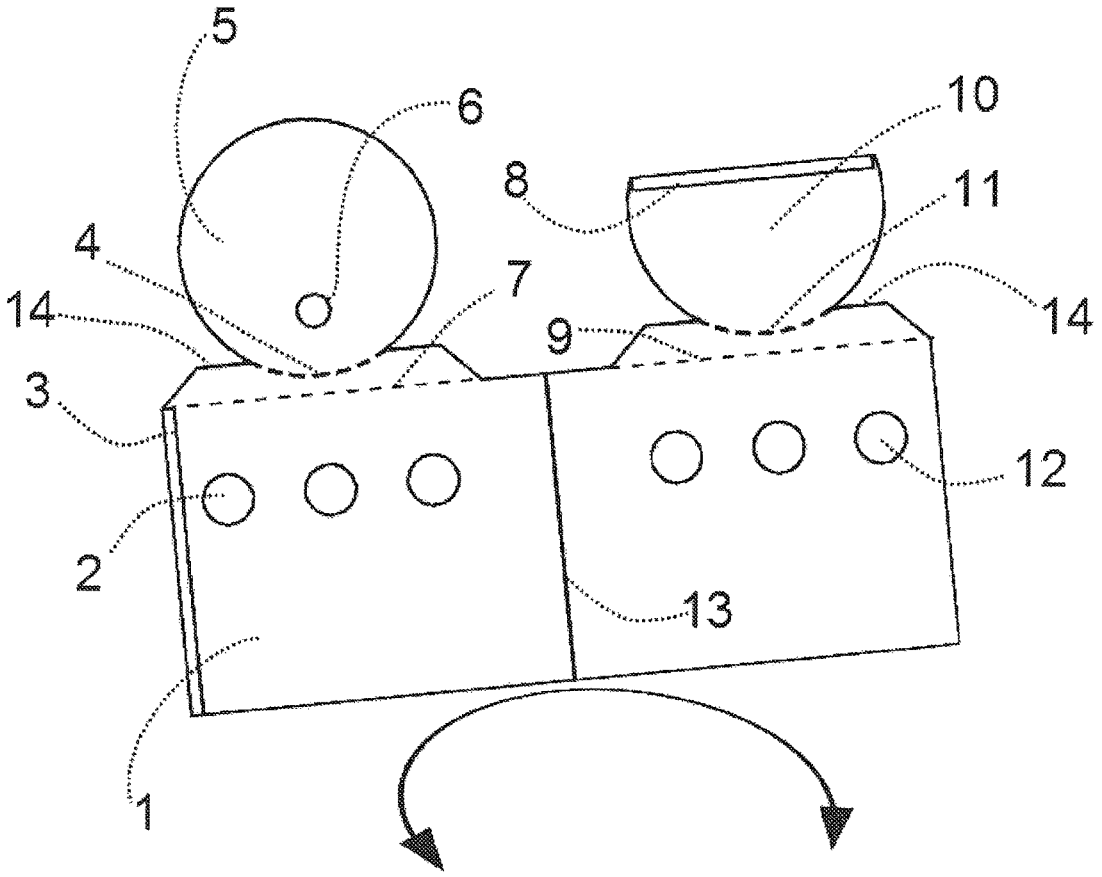
FIG. 1 shows a pattern view of a food transit guard according to a first embodiment of the present invention.
Figure 2:
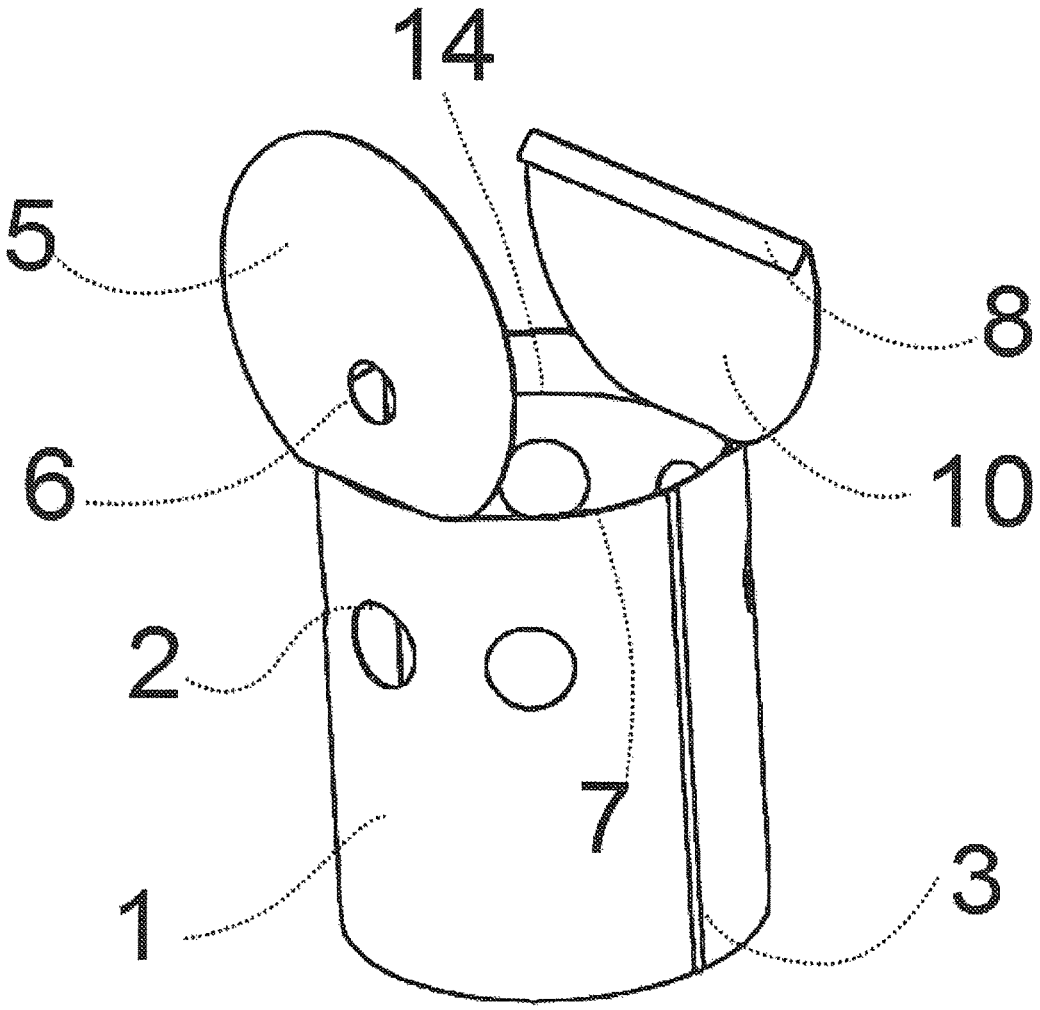
FIG. 2 shows the food transit guard of FIG. 1 partly assembled.
Figure 3:
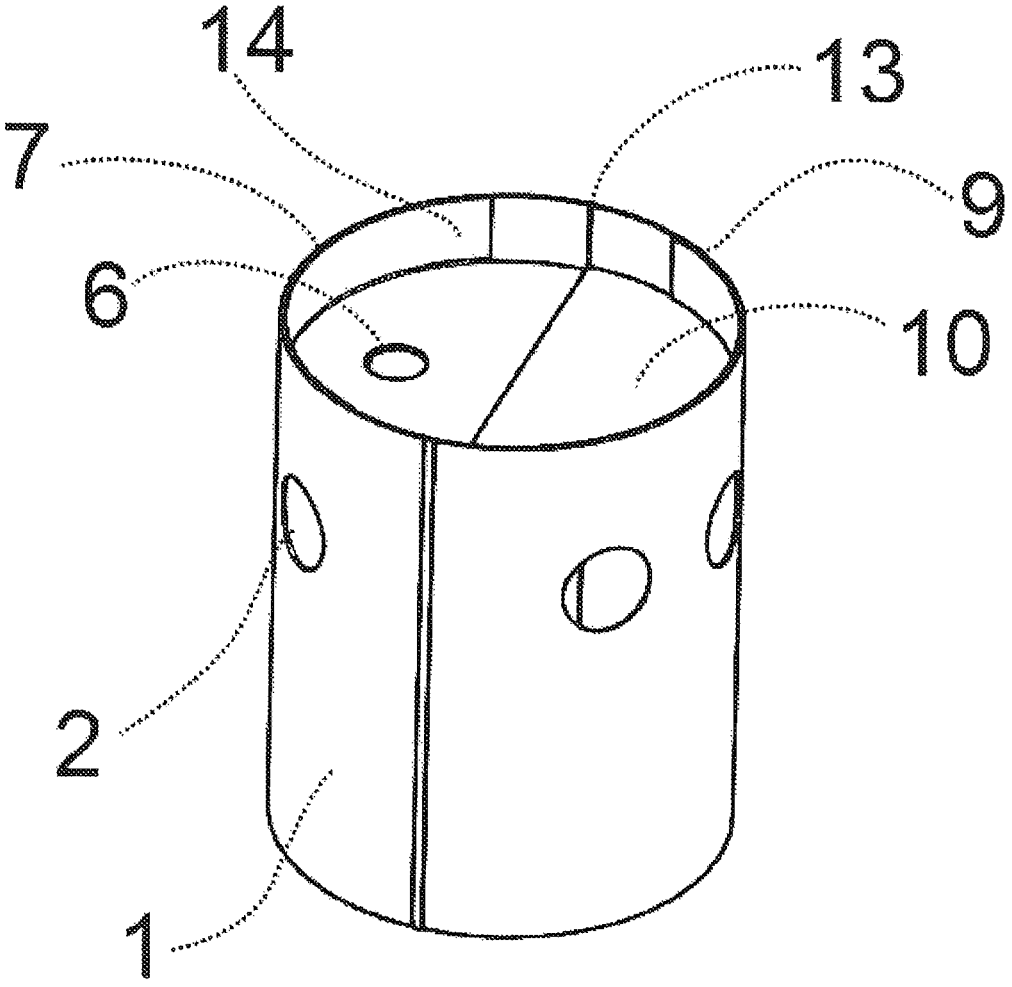
FIG. 3 shows the food transit guard of FIG. 1 fully assembled.

Referring to FIGS. 1 to 3, a transit guard 1 is shown being made from an elongated, foldable, sheet material which, initially flat, can have its two opposing vertical edges or ends joined by an appropriate adhesive strip, 3. Alternatively a plurality of vertical slits on opposing ends could be designed to intersect one another forming a less rigid bond. The guard could also be formed as a solid structure of metal, plastic, organic or composite nature formed via an appropriate combination of moulding and/or machining.

Figure 4:
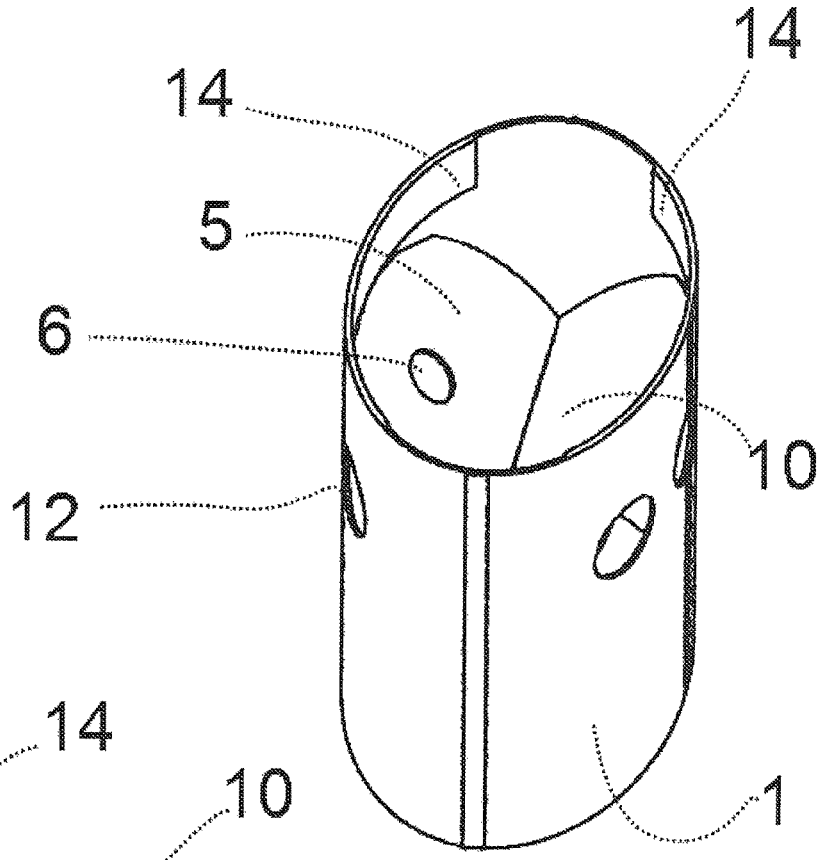
FIGS. 4, 5 and 6 show how the assembled food transit guard may be folded into a flat-packed configuration.
Figure 5:
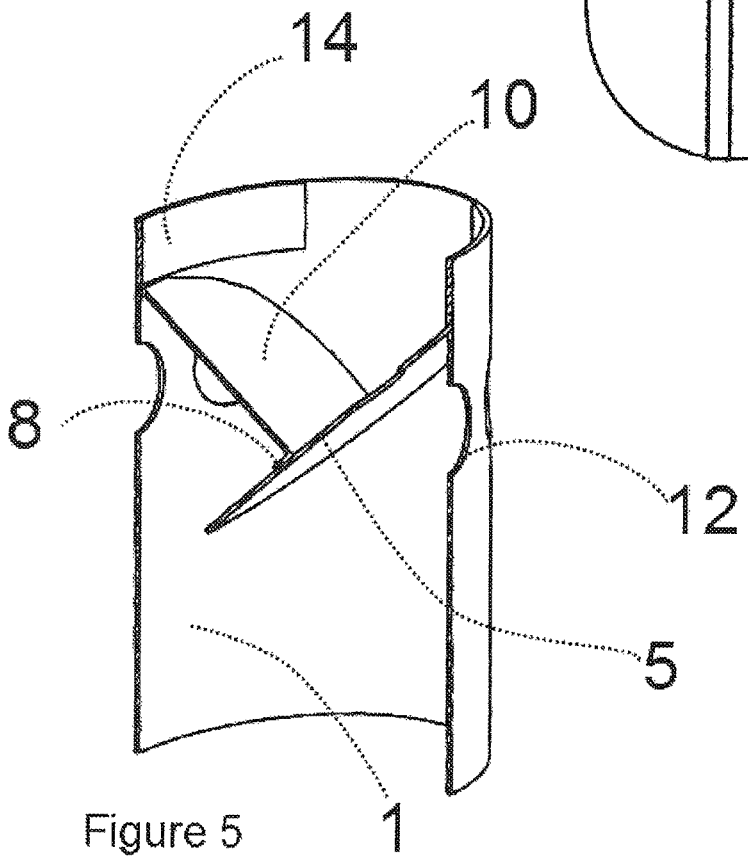
Figure 6:
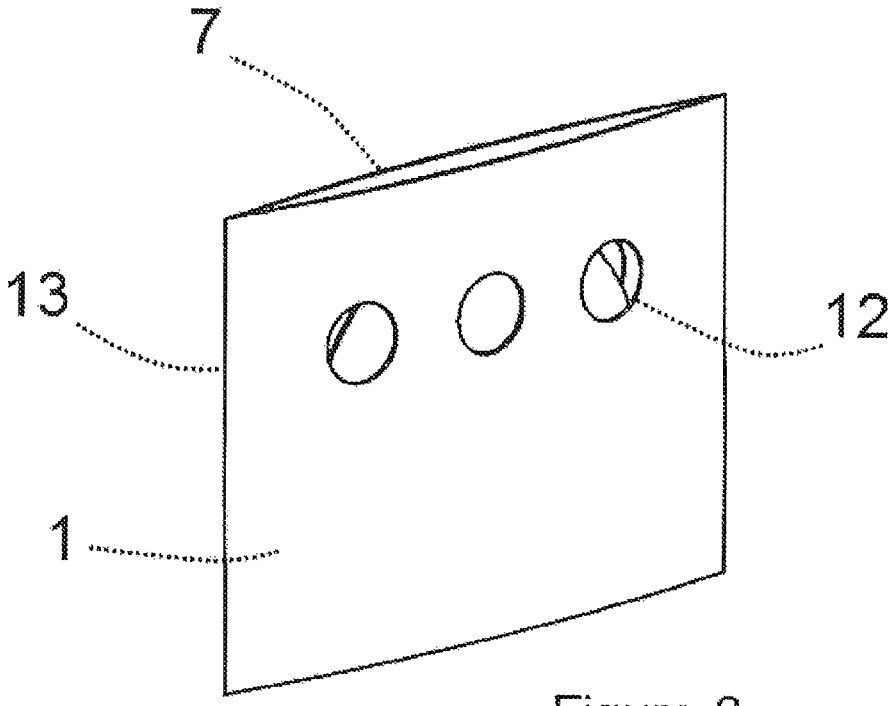

FIGS. 4 to 6 show how a substantially circular tubular transit guard, formed of elongated, foldable, sheet material as shown in FIG. 1 can be folded into a flat pack configuration and stored flat, and erected when required for use. This saves considerably on storage space. FIG. 1 shows the flat or pattern view of the material, which has a fold line 13. Item 3 in FIG. 1 shows the area where adhesive should be applied, in order to affix the opposing end edges making, in this case, a tubular shape of substantially circular cross section, as shown in FIG. 2. Following the formation of a circular tube, top or lid portions 5 and 10 are folded vertically downwards along lines 7 and 9 to create an internal lip near to the top of the cylinder formed by the edges 14.

Portion 5 comprises a closure portion dimensioned to substantially match the cross sectional shape of the transit guard to close it. The closure portion 5 is hinged to the transit guard periphery, preferably near one end of the periphery, and intermediate the fold lines 13. As a result when the transit guard is folded flat, the closure portion 5 can be folded down internally and does not impede flattening.

Top portion 10 comprises a substantially semi-circular guide portion matching approximately half of the cross sectional configuration of the transit guard. Top portion 10 includes a flap which glues or otherwise adheres to the top portion 5 along respective centre lines. Top portion 10 is hingedly mounted to the opposing side of the periphery of the transit guard, again intermediate the hinge portions. The line of adhesion between top portion 9 and top portion 10 is aligned with the diameter of the transit guard intersecting the fold lines such that, in the flattened configuration top portion 10 also folds down into a flat position as can be seen in FIG. 5. Hence the upper face of top portion 10 and the opposing half of top portion 5 form a closure and the remainder of top portion 5 provides additionally structural strength.

When the folded configuration is opened out, portions 5 and 10 are then folded to the horizontal position along lines 4 and 11 respectively with portion 10 resting on top of portion 5. Area 8 shows where adhesive should be applied to affix portions 5 and 10 together into a substantially circular disc 1, resting substantially horizontally as shown in FIG. 3, or in other words substantially perpendicular to the axis of the cylindrical tube, inside the tube, and butted up to the small lip created by edge 14. This then forms the top of the transit guard and maintains the cross section of the folded material. FIG. 3 shows the assembled erect transit guard. FIGS. 4 and 5, FIG. 5 being a sectional view for clarity purposes, show how by then depressing the intersection of 5 and 10 the top will collapse inside the tubular body of the transit guard by virtue of fold 8 and the tube can then be folded along line 13 and the diametrically opposite line on the other side of the tube to completely flatten the transit guard as shown in FIG. 6.

The transit guard 1 may have apertures or ventilation holes 2 around the circumference, and also one or more apertures 6 on the top of the guard to allow moisture to escape from the area inside the transit guard where the food is located. This moisture may escape into the gap between transit guard and the outer packaging, see FIGS. 7, 8 and 9. In addition a plurality of ventilation holes may be located in the outer packaging, such as the series of slits shown as 23 in FIG. 10, to allow moisture to be released from the food packaging into the surrounding atmosphere. In relation to the present disclosure the term plurality means one or more.

Figure 7:
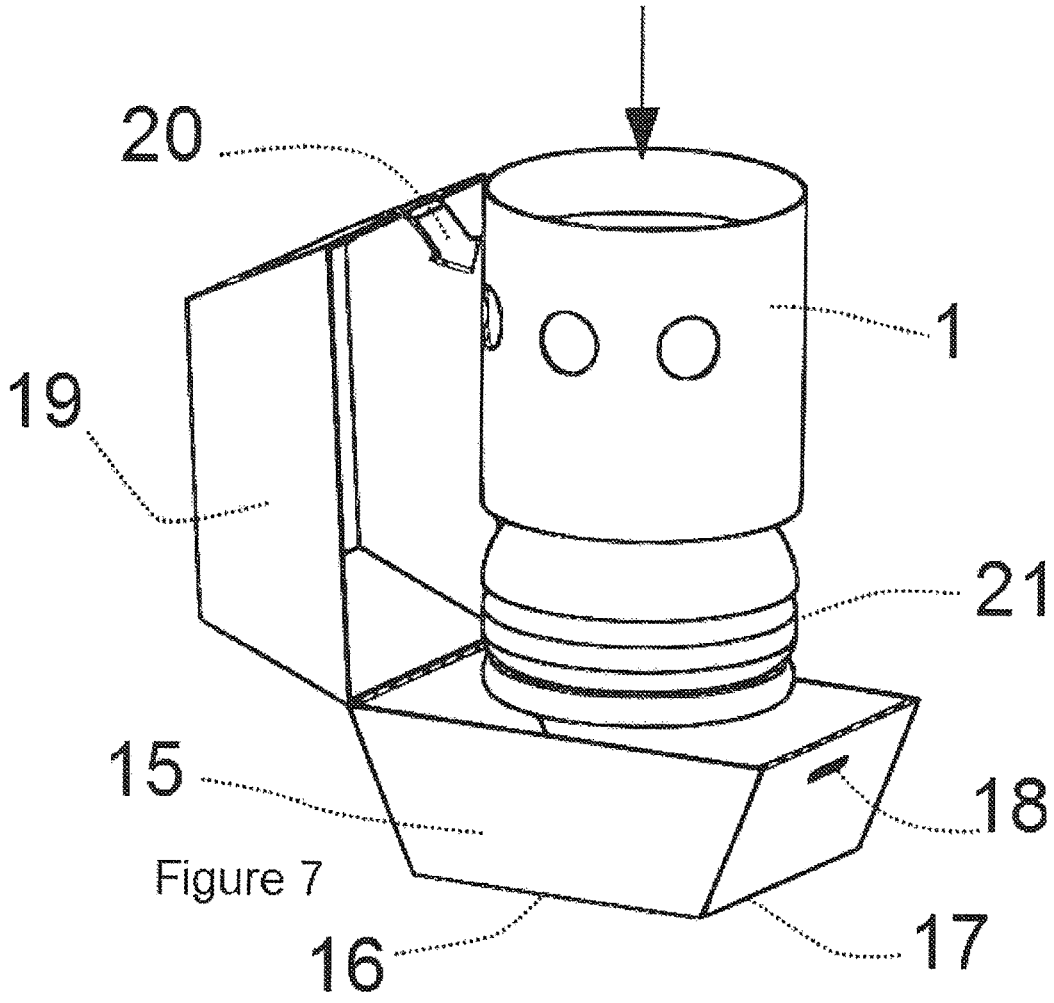
FIGS. 7 to 10 show how a transit guard according to the first embodiment, in combination with a correspondingly sized box, is used to package a burger.
Figure 8:
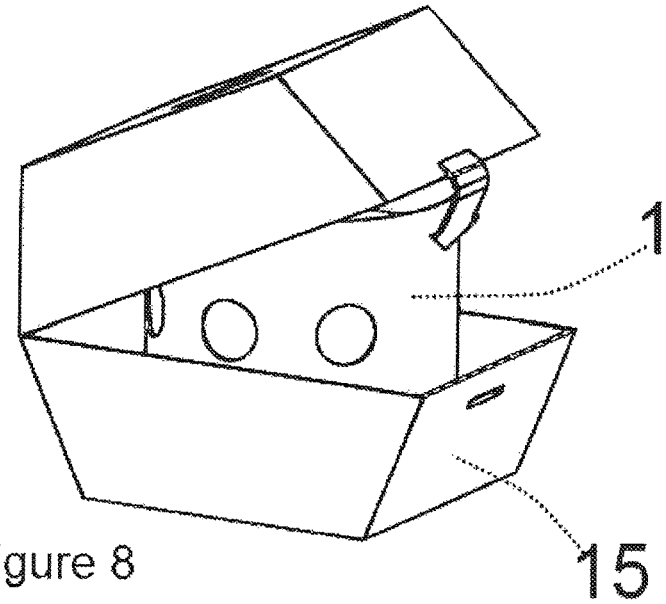
Figure 9:
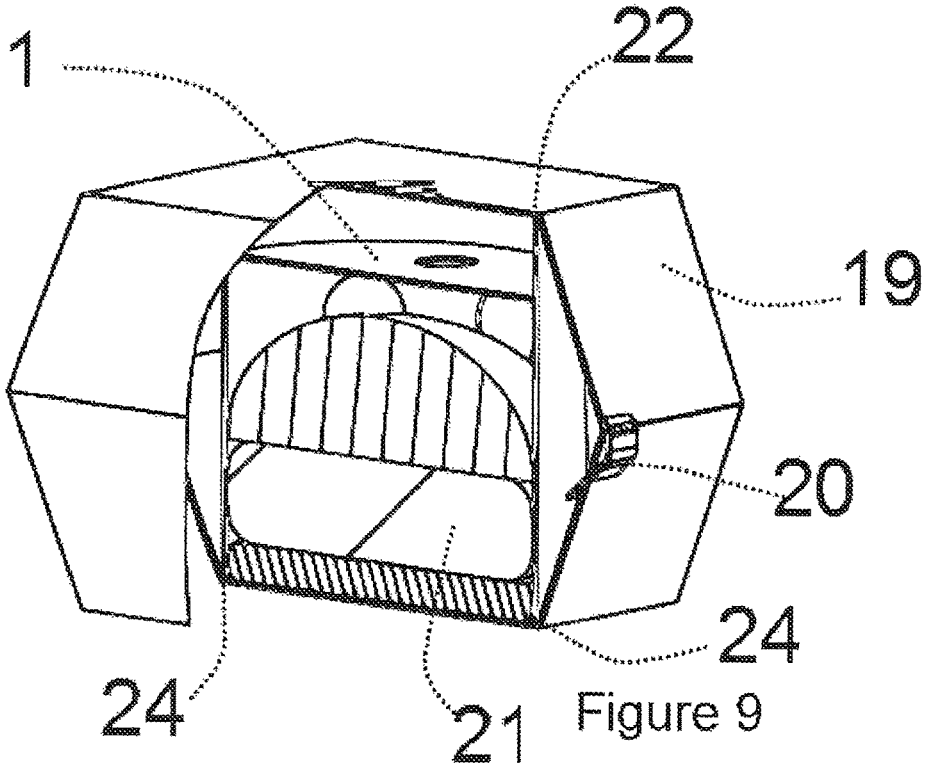
Figure 10:
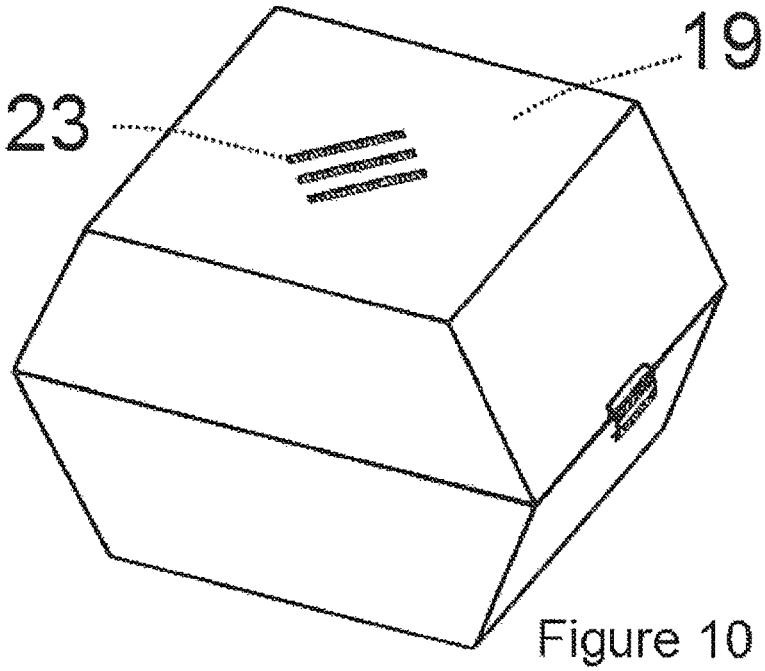

FIGS. 7 and 8 show the complete assembly of the transit guard 1, housing a sandwich 21, enclosed in a packaging box 19. FIG. 9 then shows the packaging box and transit guard in a closed configuration. Items 24 and 22 in FIG. 9 show the close proximity, but not necessarily touching, of the transit guard and the box with respect to both the upper and lower most faces of the box, as well as the internal faces around the perimeter of the transit guard to minimise movement of the food during transit. The minimal distance or clearance space between the top of the sandwich/burger and the top of the transit guard 5, 10 prevents any significant vertical movement of the sandwich within the package during transit.

Figure 11:
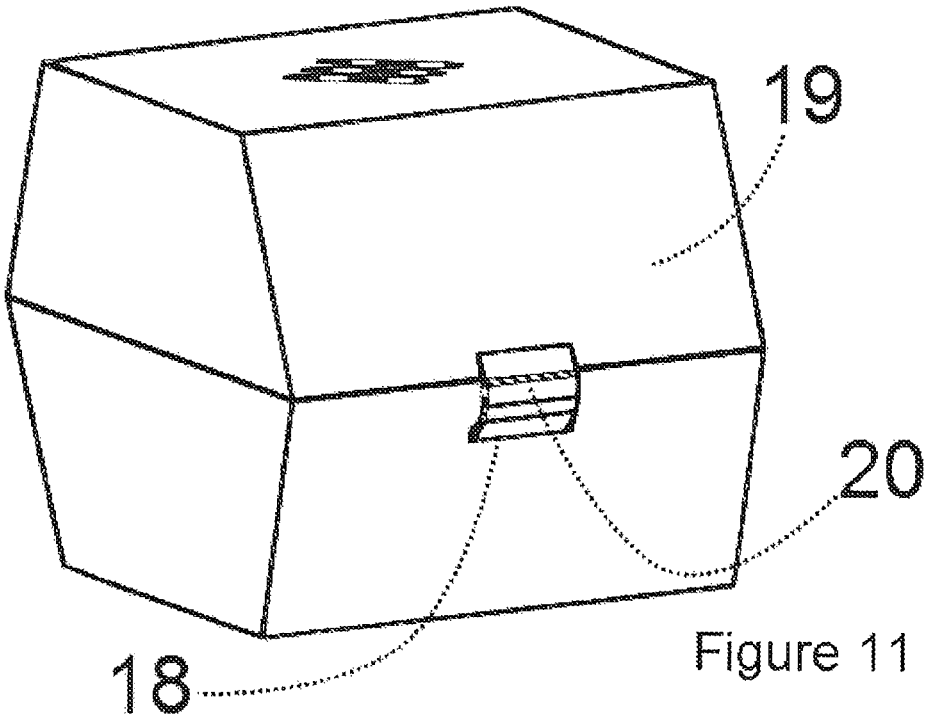
FIGS. 11 and 12 show box closure arrangements.
Figure 12:
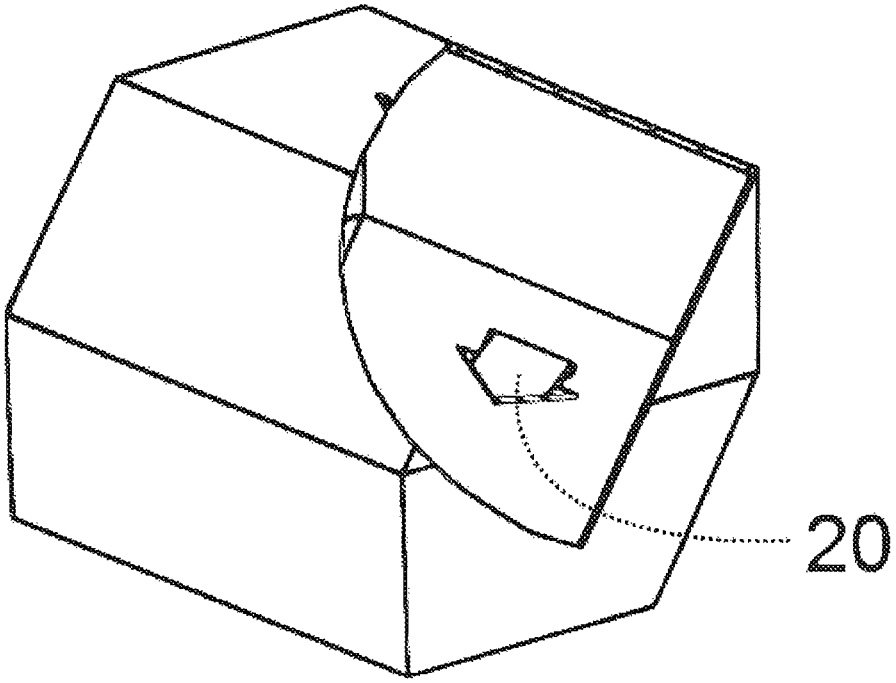
Figure 13:
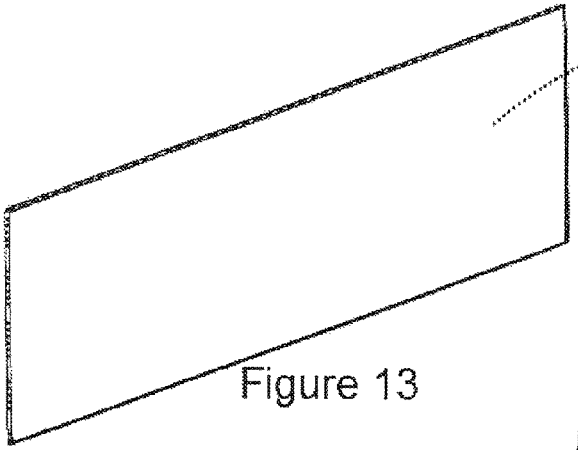
FIG. 13 shows a pattern view of a food transit guard according to a second embodiment of the present invention.

For optimum performance it is desirable for the outer packaging, of whatever shape chosen, to incorporate some method or locking means to keep it closed. An example of how this may be achieved is shown in FIGS. 11 and 12. A flap of material 20 which has an arrow shape at its end and which extends for approximately 5 cm, protrudes from the top of the box 19. A corresponding slit 18 is cut in the opposing half of the box whose horizontal width is slight less than the widest point of the arrow 20. Thus to achieve a closing lock the arrow is inserted into the slit 18 by pushing through one of the wider parts through first, until the nominal width of the tab 20 is touching the edge of the slit 18 then simply inserting the opposing wide point on the arrow.

In the examples described thus far, the transit guard is formed from a tube or a cylinder whose wall(s) are substantially complete around the perimeter of the cylinder or tube. This is not essential for the transit guard to perform its function. Thus vertical or horizontal slits or other openings may be present in the wall(s) of the cylinder body. Thus a non-continuous cylindrical body is envisaged. These slits may have other functions, such as acting as supports for one or more cross-members to be inserted across the cylinder just above the top of the sandwich, such that the top of the sandwich is prevented from lifting during transit.

It will also be appreciated that the cylindrical body of the transit guard could be formed in a plurality of portions formed by horizontal or vertical sectioning of an otherwise substantially complete cylinder. This arrangement works better if the various portions of the cylinder are attached to the inside of a packaging box, such that the various elements of the transit guard come together as the box is closed.

It is intended that all of these various constructional variations form part of the present invention.

Figure 14:
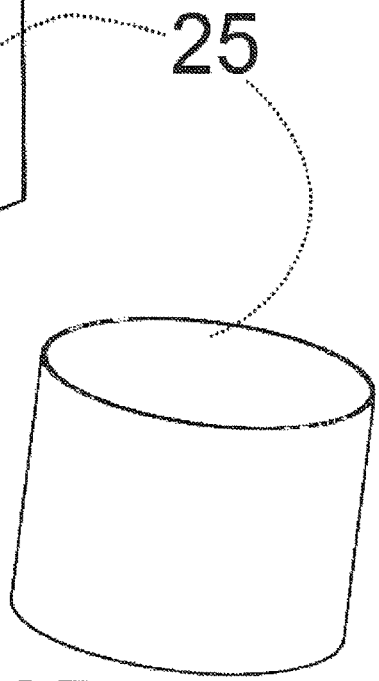
FIG. 14 shows the food transit guard of FIG. 13 fully assembled.
Figure 15:
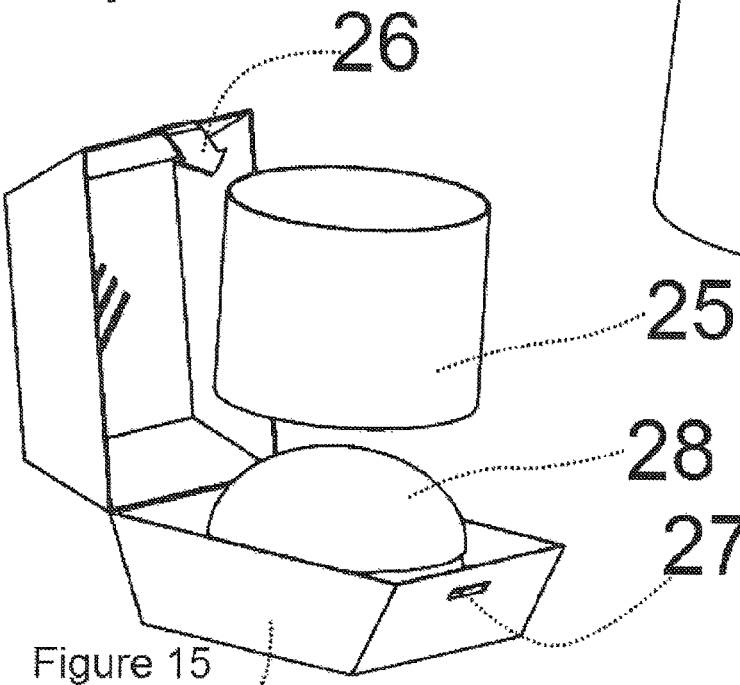
FIGS. 15 and 16 show how a transit guard according to the second embodiment, in combination with a correspondingly sized box, is used to package a burger.
Figure 16:
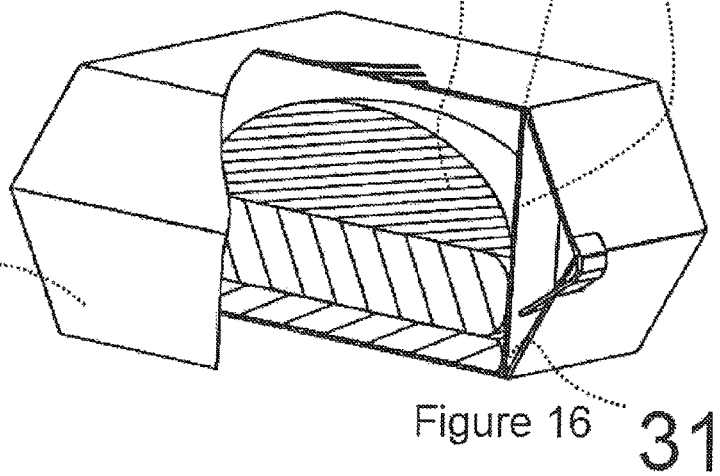

A second embodiment of the present invention will now be described with reference to FIGS. 13 to 16. This embodiment, which does not necessarily include the ability to fold flat, or include as many ventilation holes in the transit guard as the first embodiment, can be created and assembled as shown in FIGS. 13-16. A sheet of elongated foldable material 25 can be used to create a tubular transit guard (shown as a substantially circular tubular cylinder in FIG. 14) which does not include a top. By joining the opposing vertical ends of sheet 25 either with adhesive, vertical slits or any other suitable fixing means, this forms a ring as shown in FIG. 14. Alternatively, as with the more complex transit guard discussed above, the transit guard may be made from a solid metal, plastic, organic or composite material if preferred. This second embodiment of the transit guard is still required, in use, to be in close proximity to the upper and lower surface of an outer box to reduce rotation and vertical movement of the guard within the box. As before, the outer circumference of the tubular transit guard is also required to be in close proximity to the internal edges around the perimeter of the upper and lower surface of the outer box to reduce lateral movement and rotation of the transit guard relative to the outer box 31 during transit. In this instance the box packaging, and subsequently transit guard, would ideally be of a height which minimises the distance between the upper surface of the outer box and the highest point on the top of the sandwich/burger 30 to approximately 1 to 5 cm to prevent excessive vertical movement of the sandwich relative to the transit guard and outer packaging.

Any available surface of the transit guard or box may well be branded with logos or insignia providing the nature of the printing on any areas in direct contact with the food complies with health and safety regulations of the relevant territory.

The size and shape of all parts of the assembly, including the transit guard and outer box will naturally need to be adapted to the dimensions of the sandwich which is being transported. Furthermore, where the transit guard is formed from a solid metal, plastic, organic or composite material, this material will preferably be chosen such that the transit guard is re-useable and can be cleaned, and if necessary sterilised, between uses.

The invention claimed is:

1. A foodstuff packaging assembly for transporting foodstuff having a circumferential outside edge, said packaging assembly comprising:

a substantially cylindrical transit guard having a top end edge at one end of the cylinder, a bottom end edge at the other end of the cylinder and a side wall having an internal sidewall surface and an external sidewall surface, the internal sidewall surface of the transit guard being sized, shaped and configured so as to substantially correspond to the circumferential outside edge of a foodstuff in order to restrain the foodstuff during transit, the transit guard having diametrically opposed fold lines to permit folding and unfolding;

a top portion comprising a closure portion shaped to substantially correspond to the cross sectional shape of the transit guard in an unfolded configuration of the transit guard, said closure portion acting to substantially close the top end of the cylinder when the transit guard is in an unfolded configuration, said closure portion being hingedly mounted to a portion of the sidewall to be able to fold to a flat portion when the transit guard is folded into the folded flat-packed configuration; and a guide portion hingedly mounted at a first end to an opposing portion of the sidewall and hingedly connected at a second end to the closure portion in alignment with the fold lines of the transit guard to form with the closure portion the top portion of the assembly in the unfolded configuration and to guide the closure portion to fold to the flat position in the folded flat-packed configuration by depressing the second end of the guide portion;

wherein the top portion of the transit guard is foldable between a folded, flat-packed configuration and an unfolded open configuration, and wherein the second end of the guide portion is hingedly connected to the closure portion by a flap of the guide portion, and wherein, when the transit guard is in the unfolded open configuration, the flap extends back towards the opposing portion of the sidewall such that the flap and the guide portion cover a first section of the closure portion, a second section of the closure portion including at least one aperture.

2. A foodstuff packaging assembly as claimed in claim 1 wherein the cylindrical transit guard comprises a substantially circular cylinder.

3. A foodstuff packaging assembly as claimed in claim 1 wherein the cylindrical transit guard comprises a polygonal sided cylinder.

4. A foodstuff packaging assembly as claimed in claim 1 wherein the cross-section of the cylinder of the cylindrical transit guard is substantially uniform in cross-section along substantially the height of the cylinder.

5. A foodstuff packaging assembly as claimed in claim 1 further comprising one or more ventilation holes.

6. A foodstuff packaging assembly as claimed in claim 5 wherein at least one of the ventilation holes is located in the sidewall of the cylindrical transit guard.

7. A foodstuff packaging assembly as claimed in claim 5 wherein at least one of the ventilation holes is located in the top portion of the cylindrical transit guard.

8. A foodstuff packaging assembly as claimed in claim 1 wherein the cylindrical transit guard is formed from a foldable sheet material.

9. A foodstuff packaging assembly as claimed in claim 1 further comprising a packaging box adapted to accommodate the cylindrical transit guard, said packaging box comprising a bottom portion having a lowermost-in-use internal bottom surface, a top portion having an uppermost-in-use internal top surface, and at least one side wall having an internal side surface, the top portion and the bottom portion being adapted and such that the packaging box can adopt an open configuration or a closed configuration.

10. A foodstuff packaging assembly as claimed in claim 9 wherein the top portion and the bottom portion of the packaging box are pivotally or hingedly connected.

11. A foodstuff packaging assembly as claimed in claim 9 wherein the packaging box further comprises a fastening means adapted to retain the packaging box in a closed configuration.

12. A foodstuff packaging assembly as claimed in claim 9 wherein the height of the cylindrical transit guard substantially corresponds to the internal height of the packaging box in its closed configuration.

13. A foodstuff packaging assembly as claimed in claim 9 wherein the cylindrical transit guard has a diameter that substantially corresponds to a diameter or width of the packaging box.

14. A foodstuff packaging assembly as claimed in claim 13 wherein the operative diameter or width of the packaging box is the diameter or width of the lowermost-in-use internal surface of the packaging box or the uppermost-in-use internal top surface of the packaging box, or both.

15. A foodstuff packaging assembly as claimed in claim 9 wherein the packaging box further comprises one or more ventilation holes.

* * * * *